United States Patent [19]

Cillario

[11] Patent Number: 4,538,731

[45] Date of Patent: Sep. 3, 1985

[54] CONTAINER FOR SMALL OBJECTS, PARTICULARLY PASTILLES AND SIMILAR CONFECTIONERY PRODUCTS

[75] Inventor: Lorenzo Cillario, Alba, Italy

[73] Assignee: Ferrero S.p.A., Alba, Italy

[21] Appl. No.: 608,094

[22] Filed: May 8, 1984

[30] Foreign Application Priority Data

Jun. 30, 1983 [IT] Italy ..... 53532/83[U]

[51] Int. Cl.[3] ..... B65D 85/60; B65D 43/16

[52] U.S. Cl. ..... 206/540; 220/254; 220/306; 220/339

[58] Field of Search ..... 206/540, 530; 220/339, 220/324, 307, 254, 306

[56] References Cited

U.S. PATENT DOCUMENTS

| | | | |
|---|---|---|---|
| 3,685,684 | 8/1972 | Schindler et al. | 220/324 |
| 3,872,996 | 3/1975 | Dogliotti | 220/254 |
| 3,966,080 | 6/1976 | Bittel | 220/307 |
| 4,144,985 | 3/1979 | Kinslow | 220/307 |
| 4,163,496 | 8/1979 | Dogliotti | 206/538 |
| 4,220,252 | 9/1980 | Beall et al. | 220/307 |

FOREIGN PATENT DOCUMENTS

| | | | |
|---|---|---|---|
| 1258979 | 1/1972 | United Kingdom | 206/339 |

*Primary Examiner*—William T. Dixson, Jr.

*Attorney, Agent, or Firm*—Bernard, Rothwell & Brown

[57] ABSTRACT

A small flip-top container which can be opened and shut using one hand is closed at one end by a stopper having a skirt which grips the inside of the container resiliently and a rectangular end wall with an aperture which extends for a certain distance from one of the minor sides. The aperture is closeable by a flap which is hinged integrally to the end wall at the inner end of the aperture and is held shut by the snap-engagement of a transverse heel formed on a projection from the free end of the internal surface of the flap in a complementary transverse groove from in the minor wall of the skirt immediately below the outer end of the aperture. In order that the flap can be snapped open and shut without excessive force, the frontal edge of the minor wall of the skirt defining the top of the groove has a central part which projects outwardly relative to its lateral parts, over which the heel must pass. For strength, the internal surface of the flap has two lateral ribs which extend for about a third of its length from its free end.

1 Claim, 5 Drawing Figures

Figure 1:
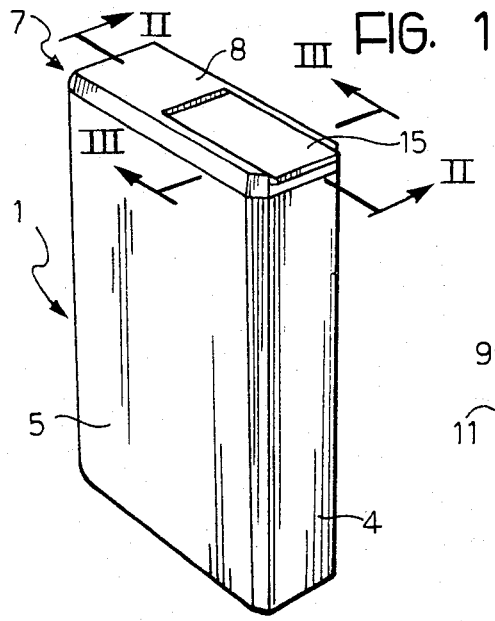

CONTAINER FOR SMALL OBJECTS, PARTICULARLY PASTILLES AND SIMILAR CONFECTIONERY PRODUCTS

The present invention relates to containers for small objects and in particular to containers of the portable type for containing pastilles and similar confectionery products, adapted in such a way as to be capable of being held, opened and closed by the user with the use of only one hand.

Containers of the type specified above are already known, manufactured by means of injection moulding of plastics material and comprising a hollow body having substantially the form of a right prism which includes a rectangular base wall from the opposing sides of which rise two pairs of lateral walls of equal length, defining with their edges opposite the base wall an entry opening to the hollow body.

The known containers mentioned above also include a hollow closure element or stopper of plastics material having a flat end of rectangular plan with dimensions corresponding substantially to those of the external perimeter of the edges of the lateral walls of the hollow body defining the respective entry opening.

This end carries a skirt which is perpendicular thereto and has, for a certain distance from its outer surface, dimensions such that it can be introduced into the hollow body and grip resiliently the end parts of the internal surfaces of the lateral walls of the body itself, opposite the respective base in the assembled condition of the container. In the end of the closure element is formed a rectangular aperture whose larger axis coincides with the similar axis of the end itself, and which extends from one of the minor sides of the latter and communicates with the outside in correspondence with this minor side. A flap for closing the aperture, constituted by a plate with flat and parallel faces, is formed integrally with the end and is hinged, by means of a portion of reduced section constituting an integral hinge, to the aforesaid end in correspondence with that end of the aforesaid aperture opposite the said minor side, about an axis parallel to this latter. The length of the flap is such that the terminal portion of its free end part extends axially beyond the said minor side and functions as a gripping tab when the flap is brought into its closure position.

The end part of the flap and the minor wall of the skirt underneath the zone where one end of the aperture communicates with the outside are formed with cooperating snap-engagement means constituted by a transverse projection which is formed on the internal surface of the end part of the flap parallel to its hinge axis at a distance from this axis greater than that which separates the latter from the external surface of the minor wall of the skirt, and further constituted by a transverse heel formed parallel to the hinge axis on the surface of the projection facing towards the interior of the closure element, and by a transverse recess or groove with a section complementary to that of the heel and formed in the section of the external surface of the aforesaid minor lateral wall of the skirt.

In containers of this type, the thickness of the flap and the dimensions of its transverse projection are such that together they constitute a rigid component which is substantially non-deformable under the stresses applied to the aforesaid gripping tab during the operations of opening and closing the container, whereby, during such operations, the portion of the flap constituting the integral hinge responds elastically in a spring-like manner to the tensile stresses applied to the flap by the snap-engagement means.

Moreover, the distance of the coupling surfaces of the snap-engagement means from the hinge axis is such that, in the closed position of the flap, the latter is subject to a tensile stress and that portion of the flap constituting the integral hinge is extended elastically by this stress.

All this means that the snap-closing of the stopper requires an excessive force on the part of the user and that all the parts of the stopper itself, that is, the end, the flap, the walls of the skirt and the integral hinge, must have fairly considerable thicknesses to ensure the desired functioning. This results in an excessive consumption of plastics material in places of manufacture of the closure elements and limitations to the choice of the type of plastics material used in the manufacture itself.

The principal object of the present invention is that of providing a container of the general type specified previously, in which the closure element or stopper, although ensuring satisfactory sealing of the container in the closed condition, allows the snap-closing of the stopper without the use of excessive force.

A further object of the invention is that of realising a container in which the walls of the stopper and its closure flap can have a relatively small thickness but still be able to maintain the transverse projection provided with the heel in the appropriate position with respect to the plane of the flap, notwithstanding the considerable flexibility of the latter due to its small thickness.

According to the present, the principal object of the invention is achieved by virtue of the fact that the closure element or stopper of the container is shaped in such a way that the frontal edge of the wall which defines the top of the recess in which the heel of the lower transverse projection of the flap is snap-engageable has a central part which projects further than its lateral parts, these preferably being set back slightly with respect to the external surface of the minor wall of the skirt in which the recess is formed. To achieve the further object, the flap has, as known in itself, a smaller thickness than the end of the closure element and is provided with two lower lateral longitudinal ribs which are perpendicular to it and extend to said transverse projection from a zone spaced from the hinge by a distance preferably equal to about a third of the length of the flap itself.

Figure 3:
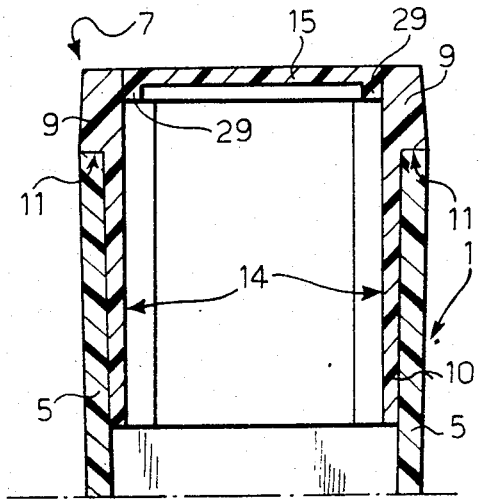
Figure 2:
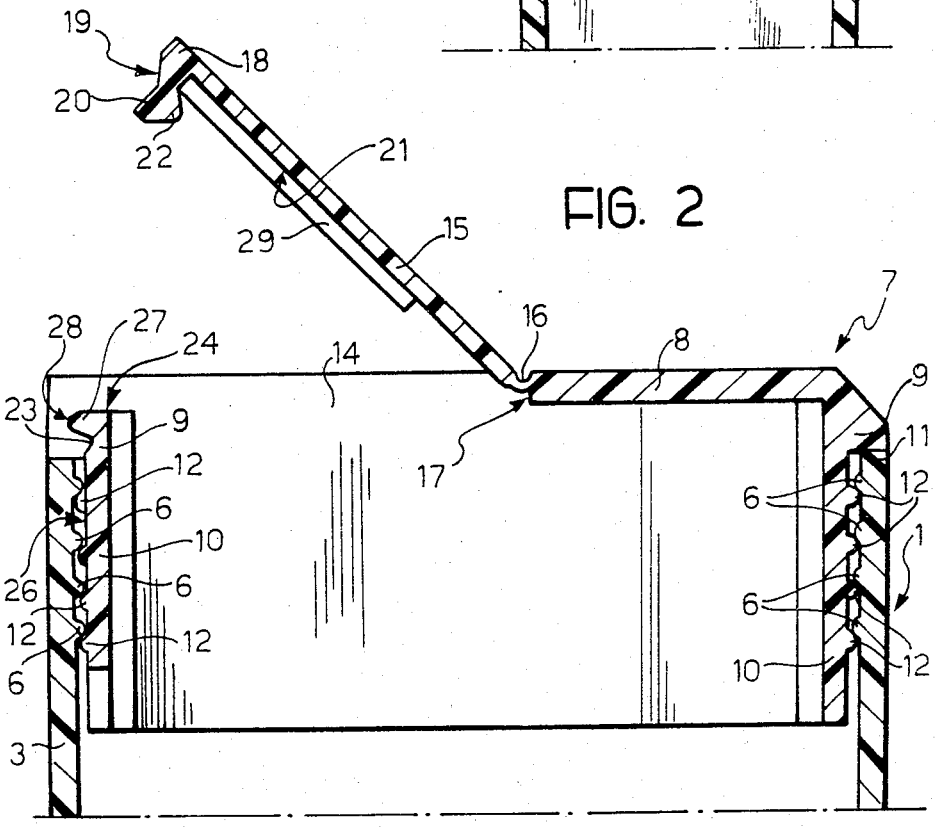
Figure 4:
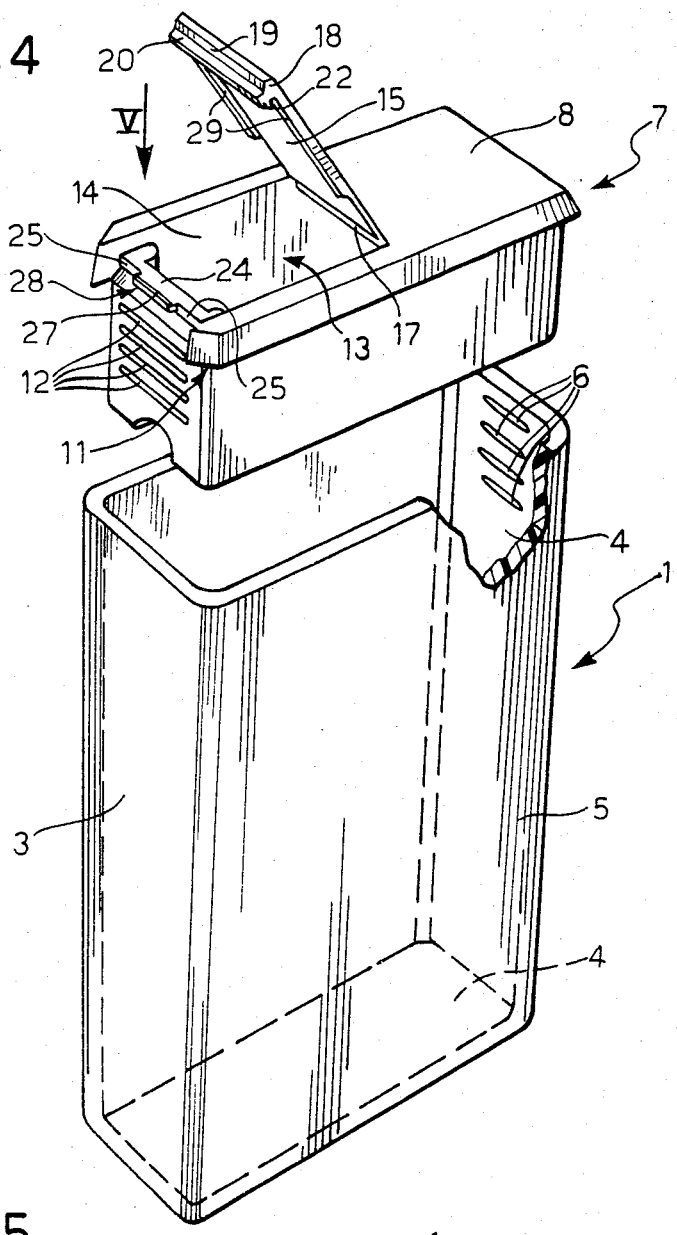
Figure 5:
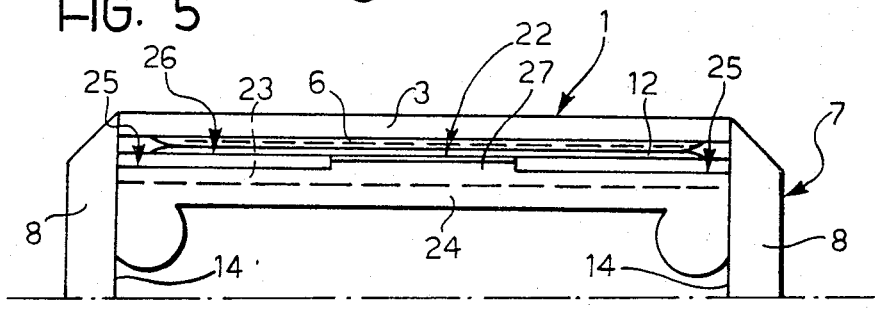

Further characteristics and advantages of the invention will emerge from the description which follows with reference to the appended drawings, provided purely by way of non-limiting example, in which:

FIG. 1 is a perspective view of a container according to the present invention, FIGS. 2 and 3 are sections taken along the lines II—II and III—III of FIG. 1 on an enlarged scale, FIG. 4 is an exploded perpective view, also on an enlarged scale, showing the flap of the end of the closure element in its open condition, and FIG. 5 is a view in the direction of arrow V of FIG. 4 on a further enlarged scale.

The container illustrated in FIG. 1 has substantially the form of a right prism and has dimensions such that it can be held completely in the palm of one hand.

The container comprises a body which is injection moulded from a substantially rigid, transparent plastics material, such as polystyrene.

The body 1 is hollow and has a base wall 2 (see FIG. 4) and a lateral surface constituted by two minor walls, 3 and 4 respectively, and two major walls 5.

The upper parts of the internal surfaces of the minor walls 4 are formed with ribs 6 parallel to the respective ends.

A closure element, indicated 7, is intended to be introduced into the upper opening of the body 1 in the manner of a stopper.

The closure element 7 is injection moulded in a single piece from an opaque plastics material which is more flexible than the material forming the body 1, such as, for example, polyvinyl chloride.

It comprises an end 8 and a skirt constituted by an upper part 9 and a lower part 10.

The part 9 has a smaller depth than that of the part 10 the walls of which are contained within the external perimeter of the corresponding walls of the part 9. A connecting step 11 between the parts 9 and 10 is parallel to the end 8 and constitutes the bearing surface of the closure element 7 against the upper edge of the lateral walls 3, 4 and 5 of the hollow body 1, when the closure element 7 is inserted into the respective entry opening.

The two minor walls of the part 10 of the skirt are each provided with ribs 12 extending parallel to the end 8. When the closure element 7 is inserted into the body 1, these ribs engage between the corresponding ribs 6 formed on the internal surfaces of the upper parts of the minor walls 3 and 4 of the body 1, in order to retain the closure element or stopper 7 in the body 1 against forces directed towards the top which would tend to separate the closure element 7 from the body 1.

In the end 8 of the closure element 7 is formed an aperture 13 (FIG. 4) which extends along the major axis of the end 8 from one of its minor sides and terminates at a certain distance from the other minor side. The width of this aperture 13 corresponds to the distance between the coplanar surfaces 14 of the opposite major walls of the parts 9 and 10 of the skirt of the closure element 7. A flap 15 for closing of the aperture 13 has a width which corresponds to that of the aperture. This flap 15, whose thickness amounts to about half the thickness of the end wall 8, is formed integrally with the closure element 7 during its injection moulding. It is hinged along a portion 16 (FIG. 2) of further reduced section constituting an integral hinge, at its edge 17 which marks the internal limit of the aperture 13 opposite the outwardly facing end of the aperture 13.

The portion 16 of reduced section constituting the integral hinge is connected to the edge 17 a little below the plane in which the upper surface of the end 8 lies and at a distance a little above the plane of the respective lower surface.

When the closure element 7 is inserted in the body 1 and the flap is in its closed position (see FIG. 1), the free end part of the flap 15 extends a short distance beyond the external surface of the minor wall 3 of the body 1. This end part, indicated 18 (FIG. 2), has an inclined lower surface 19 which constitutes a gripping tab against which the thumb acts in the operation of opening the container. The inclined surface 18 terminates in correspondence with the external face of a transverse projection 20 which projects from the lower surface 21 of the flap 15. This transverse projection 20 has, in correspondence with the end part of its internal surface facing the integral hinge 16, a transverse rib or heel 22 having a substantially trapezoidal profile and extending over the whole length of the projection 20.

A transverse groove 23 with a profile complementary to that of the rib or heel 22 is formed in the part 9 of the skirt of the closure element 7 in correspondence with its minor face beneath the aperture 13.

The upper edge 24 of this minor face of the part 9 of the skirt constitutes a bearing surface for the end part of the lower surface 21 of the flap 15, when the latter is in its closure position.

As illustrated in detail in FIGS. 2, 4 and 5, the frontal edge 25 (see FIG. 5) of the wall which defines the top of the recess or groove 23 is set back slightly at the sides relative to the external surface 26 of the minor wall of the skirt in which the recess or groove 23 is formed. This frontal edge 25 has, in its central part, a projecting section 27 whose frontal face 28 is coplanar with the external surface 26 of the minor wall of the skirt, beneath the recess or groove 23.

The flap 15 is stiffened at the sides by thin longitudinal ribs 29 which extend from the projection 20 in the direction of the hinge 16 for a distance equal to about $\frac{2}{3}$ of the length of the flap.

As illustrated in detail in FIG. 3, the lateral edges of the flap and the external faces of the ribs 29 are engaged with close contact, in the closed position of the flap, between the internal surfaces 14 of the opposing walls of the closure element 7 adjacent thereto, and, during closure, contribute to maintaining the projection 20 in its appropriate position and the rib or heel 22 projecting from it in its appropriate position parallel to the axis of the integral hinge 16.

By virtue of the above described characteristics, a secure snap-closing of the stopper 7 is obtained without having to use an excessive force.

In effect, with pressure from above on the free end of the tab 15 during closing, the transverse rib or heel 22 surmounts firstly the central part 27 of the frontal edge of the recess or groove 23 and then enters the latter.

In its turn, the rib 29 contributes to maintaining the transverse rib or heel 22 in position parallel to the hinge axis of the flap 15, notwithstanding the considerable flexibility of the latter due to its small thickness, without excessive tensile stress on the integral hinge 16, due to the fact that a limited deformation of the end part of the flap carrying the projection 20 is nevertheless still permitted during the closing and opening of the flap by the upward or downward action of the user's thumb on the part 19 of the flap itself.

Naturally, the scope of invention extends to all embodiments which achieve similar utility by adopting the same innovative concept.

What is claimed is:

1. A container of the type having a hollow body having substantially the form of a right prism and including a rectangular base wall and two pairs of lateral walls of equal length which project from opposing sides of the base wall and define an entry opening into said body at their edges opposite the base wall, and a hollow, plastic closure element, the closure element including: a rectangular end surface of the closure element with dimensions corresponding substantially to the external perimeter of the edges of said lateral walls defining said entry opening; a skirt extending perpendicularly from said end and having, for a certain distance from said end, dimensions that it can be inserted into said hollow body and grip resiliently the internal surfaces of said lateral walls adjacent said entry opening in the assembled condition of a container, a rectangular aperture defined by said end and having a major axis coincident with the major axis of said end, said aperture being closable by a closure flap, said aperture extending from one of the minor sides of said flap for said aperture, said closure flap including a plate with flat parallel faces which is hingedly connected to said end of said aperture opposite said minor side about an axis parallel to the latter by an integral hinge constituted by a reduced section portion of the flap, said flap being of a length such that a terminal portion of its free end extends axially beyond said minor side and acts as a gripping tab when said flap is closed, and cooperating snap-engagement means formed on said terminal portion of said flap and on the minor wall of said skirt beneath the external end of said aperture, said snap-engagement means being of improved construction and comprising: a transverse projection heel formed parallel to said hinge axis, on the surface of the said projection facing towards the hinge of said closure flap, and a transverse groove having a section complementary to that of said heel and snap-engageable thereby formed in the external surface of said minor wall of the skirt, a frontal edge on side minor wall of the said front edge defining the top of said groove and said frontal edge having a central part which projects outwardly relative to its lateral parts; said lateral parts being set back slightly with respect to the external surface of said minor wall of the skirt, and being coplanar with the external surface of said minor wall; said closure flap having a smaller thickness than the end surface of said closure element, and two laterally-spaced, longitudinal ribs provided on a lower surface of said closure flap which extend from a zone of said flap spaced from said integral hinge to said heel; the length of said ribs being such that they extend from a zone spaced from said hinge.

* * * * *